US009598863B2

(12) United States Patent
Hall et al.

(10) Patent No.: US 9,598,863 B2
(45) Date of Patent: Mar. 21, 2017

(54) TEMPORARY PLATFORM

(75) Inventors: Charles Hall, Hants (GB); Chris Pitchford, Farnham Surrey (GB)

(73) Assignee: HEXAGO DECK LIMITED, Hants (GB)

( * ) Notice: Subject to any disclaimer, the term of this patent is extended or adjusted under 35 U.S.C. 154(b) by 0 days.

(21) Appl. No.: 14/003,710

(22) PCT Filed: Mar. 8, 2012

(86) PCT No.: PCT/EP2012/053986
§ 371 (c)(1),
(2), (4) Date: Dec. 9, 2013

(87) PCT Pub. No.: WO2012/120072
PCT Pub. Date: Sep. 13, 2012

(65) Prior Publication Data

US 2014/0130427 A1 May 15, 2014

(30) Foreign Application Priority Data

Mar. 8, 2011 (GB) ..... 1103910.4

(51) Int. Cl.
*E04B 5/43* (2006.01)
*E04H 3/28* (2006.01)
(Continued)

(52) U.S. Cl.
CPC ..... *E04B 5/43* (2013.01); *E04B 5/02* (2013.01); *E04F 11/02* (2013.01); *E04H 3/12* (2013.01); *E04H 3/24* (2013.01); *E04H 3/28* (2013.01)

(58) Field of Classification Search
CPC .... E04H 3/12; E04H 3/24; E04H 3/28; E04B 5/02; E04B 5/04; E04B 5/43;
(Continued)

(56) References Cited

U.S. PATENT DOCUMENTS 1,549,205 A * 8/1925 Meyercord ..... E04B 1/6104 160/38
1,967,620 A * 7/1934 Kahn ..... 404/21
(Continued)

FOREIGN PATENT DOCUMENTS

DE 202005008688 U1 10/2005
FR 2614341 A1 * 10/1988 ..... E04H 3/24
(Continued)

OTHER PUBLICATIONS

Wade, Eleanor; Combined Search and Examination Report, Date of Mailing of Report: Jul. 5, 2012, Great Britain Application No. GB1204105.9.

(Continued)

*Primary Examiner* — Robert Canfield
(74) *Attorney, Agent, or Firm* — Gavrilovich, Dodd & Lindsey LLP

(57) ABSTRACT

Provided is a modular construction kit adapted to construct a raised temporary platform, the modular construction kit comprising one or more floor elements (1), wherein the floor element (1) comprises a monocoque structure (6) forming a floor section (21) and a flange section (3), wherein the flange section (3) is adapted to strengthen the floor element (1) and is adapted to be attached to a further floor element (1), wherein the floor elements (1) are load bearing and cooperate together to bear the load of the platform so as to form a self-supporting floor, without the requirement for a supporting floor frame.

33 Claims, 18 Drawing Sheets

Figure 1A:
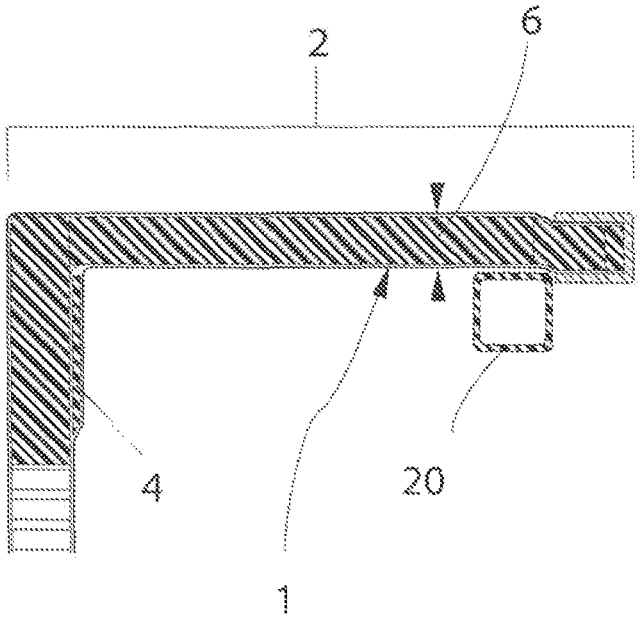

(51) Int. Cl.

| | |
|---|---|
| ***E04H 3/24*** | (2006.01) |
| ***E04H 3/12*** | (2006.01) |
| ***E04B 5/02*** | (2006.01) |
| ***E04F 11/02*** | (2006.01) |

(58) Field of Classification Search

CPC E04B 2001/2484; E04F 15/024; E04F 15/05; E04C 2/22; E04C 2/205; E04C 2/24; E04C 2/243; E04C 2/36; E04C 2/365; E04C 2/38

USPC .... 52/7, 126.5, 126.6, 263, 319, 630, 793.1, 52/631

See application file for complete search history.

(56) References Cited

U.S. PATENT DOCUMENTS 2,245,497 A * 6/1941 Potchen ..... B64C 1/18 244/129.1
3,082,489 A * 3/1963 Douglas ..... 52/262
3,323,266 A * 6/1967 Dalkas ..... 52/302.3
3,372,518 A * 3/1968 Rensch ..... 52/223.7
3,811,237 A * 5/1974 Bettinger ..... E04F 15/02452 52/126.6
3,857,752 A * 12/1974 McCoy ..... E04B 1/34846 273/DIG. 7
3,932,976 A * 1/1976 Steel ..... E04B 1/12 52/309.9
3,959,423 A * 5/1976 Boyd ..... 264/34
4,078,348 A * 3/1978 Rothman ..... 52/309.7
4,598,510 A * 7/1986 Wagner, III ..... 52/126.6
4,730,428 A * 3/1988 Head et al. ..... 52/309.11
4,759,162 A * 7/1988 Wyse ..... 52/126.6
4,811,540 A * 3/1989 Kallies ..... B29D 99/0014 244/123.3
4,931,340 A * 6/1990 Baba et al. ..... 428/73
4,984,406 A * 1/1991 Friesen ..... E04B 1/12 52/284
5,034,256 A * 7/1991 Santiso, III ..... B32B 3/02 428/116
5,205,087 A * 4/1993 Jines ..... 52/6
5,271,338 A * 12/1993 Bonham ..... A47B 13/086 108/161
5,394,808 A * 3/1995 Dutro ..... A47B 3/0912 108/126
5,403,063 A * 4/1995 Sjostedt et al. ..... 296/193.07
5,947,037 A * 9/1999 Hornberger ..... A47B 13/02 108/115
5,979,684 A * 11/1999 Ohnishi ..... B62D 29/045 220/1.5
6,372,322 B1 * 4/2002 Devaguptapu ..... B32B 3/12 156/197
6,554,715 B1 * 4/2003 Gernstein ..... A63G 21/18 472/117
6,799,403 B2 * 10/2004 Winter ..... E04B 1/14 52/309.8
6,837,171 B1 * 1/2005 Clark ..... A47B 13/086 108/131
7,310,919 B2 * 12/2007 Grossman et al. ..... 52/302.2
7,874,115 B2 * 1/2011 Thiede ..... 52/506.01
8,215,063 B1 * 7/2012 Francis ..... 52/6
8,272,190 B2 * 9/2012 Schiffmann ..... B29C 44/1285 52/270
8,490,234 B2 * 7/2013 Rowell et al. ..... 14/2.4
8,534,028 B2 * 9/2013 Wojtusik et al. ..... 52/793.1
8,584,404 B2 * 11/2013 Heidenreich ..... 52/79.5
8,904,714 B2 * 12/2014 Montalto ..... E04G 21/3209 108/131
8,904,737 B2 * 12/2014 Schiffmann ..... E04B 2/56 52/270
2003/0167701 A1 * 9/2003 Rich ..... E04B 1/003 52/79.6
2005/0120650 A1 6/2005 Teramura et al.
2007/0193145 A1 * 8/2007 Wheatley ..... 52/263
2008/0016805 A1 * 1/2008 Walter ..... 52/263
2008/0053018 A1 * 3/2008 Hockemeyer ..... E04H 1/1205 52/263
2008/0127600 A1 * 6/2008 Schiffmann ..... B29C 70/443 52/741.1
2009/0110879 A1 * 4/2009 Lewis ..... B26D 3/065 428/137
2009/0142539 A1 * 6/2009 Leng ..... B32B 3/12 428/116
2010/0257796 A1 * 10/2010 Bertke et al. ..... 52/263
2012/0085057 A1 * 4/2012 Schiffmann ..... E04B 1/0007 52/309.4

FOREIGN PATENT DOCUMENTS

| | | | |
|---|---|---|---|
| GB | 2433519 | A | 6/2007 |
| GB | 2472201 | A | 2/2011 |
| WO | 2009147004 | A1 | 12/2009 |

OTHER PUBLICATIONS

Fournier, Thomas, International Search Report and Written Opinion, Date of Mailing of Report: May 23, 2012, International Application No. PCT/EP2012/053986.

Wade, Eleanor, Patents Act 1977: Search Report under Section 17, Date of Search: Jul. 6, 2011, Application No. GB1103910.4.

* cited by examiner

TEMPORARY PLATFORM

CROSS REFERENCE TO RELATED APPLICATIONS

This application is a U.S. National Stage Application filed under 35 U.S.C. §371 and claims priority to International Application No. PCT/EP12/53986, filed Mar. 8, 2012, which application claims priority to Great Britain Application No. 1103910.4, filed on Mar. 8, 2011, the disclosures of which are incorporated herein by reference.

The present invention relates to temporary platforms and modular construction kits for construction of such platforms. The platforms are typically free-standing, and are raised off the ground. Typically the platforms are designed for viewing or observation, display, storage, shows, concerts, and the like. The platforms are advantageous in that they are lighter and stronger than similar platforms known in the art. Moreover, due to the nature of the form and connectivity of the modular components, the platforms can be constructed (and removed) more quickly, and with less heavy machinery, than known temporary platforms.

Temporary viewing platforms for the events industry are known in the art. Such platforms are commonly used at festivals (such as music festivals), sporting events (such as horse racing), polo, golf, and private and corporate events. Temporary viewing platforms are generally used for short term events where a permanent structure is not desired, or permissible.

Temporary viewing platforms are commonly constructed using conventional scaffolding and/or trussing to support a platform. Alternatively, scaffolding and platform structures may be provided which have been adapted for constructing a specific type of structure such as a tiered seating structure as described, for example, in FR2585752.

One problem with many such raised structures is that the supporting scaffolding forms a cross-linked supporting structure, or at least a dense field of vertical supporting legs, which impedes access, for example because it is difficult to negotiate through on foot. As such, any temporary viewing platform constructed using these prior art arrangements provides a raised viewing platform at the expense of rendering useless the area underneath the viewing platform. Furthermore, such structures provide an obstacle to the flow of people at ground level which is problematic for events at which large crowds of people are present.

Another problem with some prior art arrangements stems from the fact that they are either adapted for one specific type or shape of structure or alternatively are not adapted for any particular type or shape of structure. The problem with systems which are not adapted for any particular type or shape of structure is that they are usually difficult and time consuming to construct into a desired structure. Conversely, the problem with systems which are specifically adapted for a particular type or shape of structure is that they do not provide much in the way of flexibility for providing different types and shapes of structure as desired. For example, for certain uses an elongate linear viewing platform may be desired, e.g. for a stage. For other uses a non-elongate viewing platform may be desired, e.g. to view out in all directions from a specific location. The required type or shape of final structure may also be determined by the space available and the contours of the land on which the temporary viewing platform is to be constructed.

Another problem with some arrangements is that they are adapted to be mounted to another structure such as a side of a building rather than being free-standing.

Yet another problem with some prior art arrangements is that they are not aesthetically pleasing, at least from certain angles. For example, supporting scaffolding is often visible from at least a rear side of a temporary viewing structure which is unsightly and undesirable, particularly at exclusive events.

Some of these problems have been solved to a certain degree. For example, WO 2009/147004 discloses a temporary viewing platform which can be erected from a modular construction kit, and is adapted for hexagonal or linear shapes, such that all-round viewing is possible. However, such platforms are still desired to be lighter and more portable, in order to increase flexibility of use, ease of construction and, facilitate more pleasing aesthetic design.

US 2005/0,120,650 discloses a 'double floor' structure. However this structure is not designed to be raised, since the first floor of the structure is formed on a base layer, such as the ground. Moreover, the space between the floors is very small, and is designed to allow space for wiring or air conditioning pipework, and could not be occupied by people. Finally, the structure is not self-supporting, and the upper floor is supported by a support means provided on the lower floor.

GB 2,472,201 A discloses a combination floor plate with integral connectors. The floor plate is intended to be laid across an existing floor or area of ground, and is not self-supporting, nor is it adapted to form raised platforms. It is typically employed as temporary protection for existing surfaces, such as during refurbishment.

GB 2,433,519 discloses a temporary flooring system, which is designed to sit directly onto a floor, or piece of ground, using a flange section of the floor pieces as a leg. The system is therefore not adapted to be raised or self-supporting.

Embodiments of the present invention aim to solve the aforementioned problems. In particular, it is an aim of certain embodiments of the present invention to provide a modular construction kit which has improved transportability, improved speed and ease of construction, and improved speed and ease of de-construction thereafter for further transport and re-use. It is a further aim to provide a modular construction kit which is adapted to construct a specific range of types and shapes of temporary platform. It is a still further aim to provide free-standing, raised platforms, the underside of which is readily accessible by people on foot (i.e. under which people can readily walk) at ground level, and which are aesthetically pleasing from a wide variety of angles.

Having identified the previously described problems associated with various prior art arrangements for platforms, the present applicant has developed a modular construction kit which solves all these problems.

Accordingly, the present invention provides a modular construction kit adapted to construct a raised temporary platform, the modular construction kit comprising two or more floor elements (1), wherein the floor element comprises a monocoque structure (6) forming a floor section (2) and a flange section (3), wherein the flange section (3) is adapted to strengthen the floor element (1) and is adapted to be attached to a further floor element (1), wherein the floor elements (1) are load bearing and cooperate together to bear the load of the platform so as to form a self-supporting floor, without the requirement for a supporting floor frame.

In the present context, the term 'raised' means that at least one floor of the platform is adapted to be raised such that none of the floor elements (1) forming the raised floor are in direct contact with the floor or ground on which the platform is constructed. The height to which the floor may be raised is not especially limited. However, typically it is able to be raised sufficiently to allow people to walk beneath it. Thus, the floor elements (1) may be lifted from contact with the ground by means of leg elements (10), stair elements (11) and/or other raising means. The raising means are not especially limited, provided that they are capable of raising the floor, as detailed above. The floor sections (2) forming the raised floor of the temporary platform remain level and are typically suitable (safe) for people to walk or stand upon. The temporary platform is self-supporting. In this context 'self-supporting' means that none of the floor elements (1) forming the raised floor of the temporary platform need to be in direct contact with the floor or ground on which the temporary platform is constructed, and the platform still remains suitable (safe) for people to stand or walk upon without the requirement for a supporting frame or other floor support means.

Thus, the present kit enables construction of a temporary platform, such as a free-standing viewing platform. In the present context 'temporary' means that the platform is readily erected and readily dismantled after use. Typically the temporary platform is re-usable. The structure is self-supporting due to the light and strong floor elements (1), which are of a unique monocoque construction (6), the special flange (3) (which may also be termed the flange part or flange section) providing a dual function of strengthening the floor and attaching the floor elements (1) together. In this way the floor plates (2) (which may also be termed floor parts, floor panels, or floor sections) are able to form an even, strong floor, whilst the floor elements (1) as a whole cooperate together so as to be self supporting. The floor elements (1) are thus load-bearing parts of the platform and are intended to support not only the weight of articles placed on the platform (and/or the viewing public) but also bear the load of the platform itself. This obviates the need for a frame, gantry, or other supporting structure that would increase the number of parts, the complexity, the size, the weight, and/or the construction/dismantlement time of the kit.

In the invention, the flange section (3) is adapted to strengthen the floor element (1). In this context the term strengthen is not especially limited, provided that some form of structural support is provided. Thus, strengthen may mean an improvement in the load bearing capacity of the floor element (1) (either alone, or when in use in a platform), and/or an improvement in: the resistance to deformation, breaking, cracking, stretching, crushing, warping, bending or the like, or any other resistance that helps to maintain the integrity of the floor element (1) and/or the platform. Improvement in this context means improvement as compared with a floor element not comprising a flange section (3), or with a floor element with a flange section that is not integral with the floor section, or with a floor element that does not have a monocoque structure.

Figure 1B:
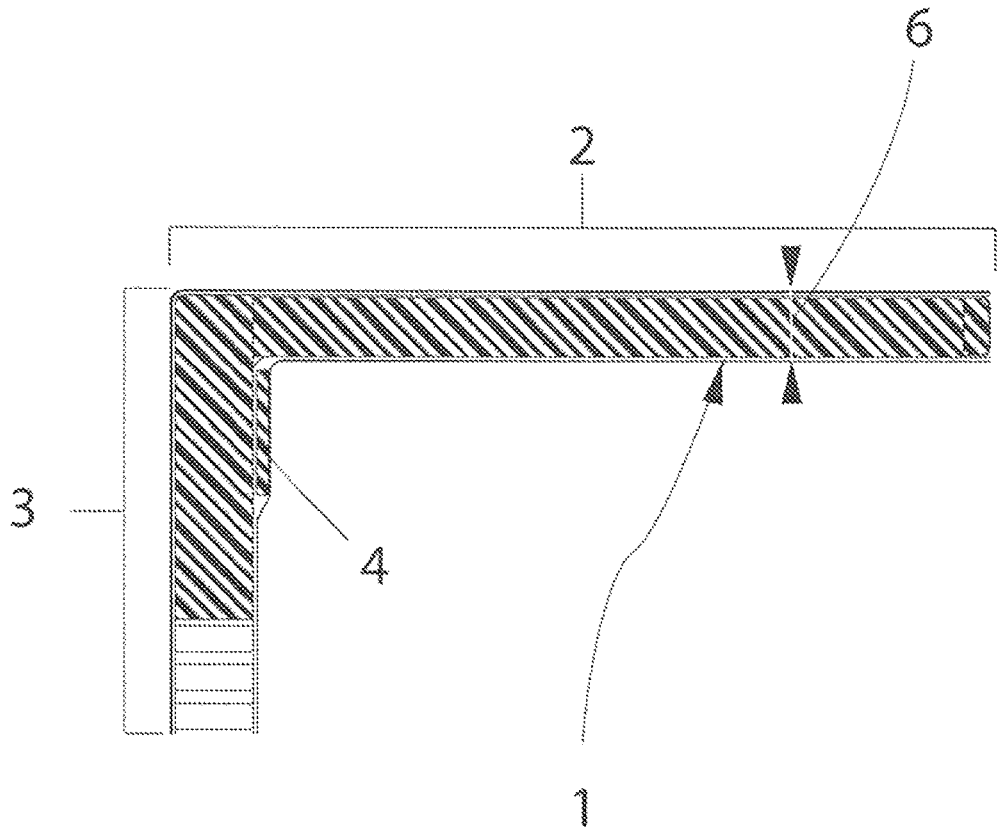

In some embodiments, the flange (3) is strengthened by providing a strengthening plate (4) on the flange section (3). In the present context 'strengthening' means any kind of strengthening as defined above, and especially stiffening. The strengthening is typically sufficient to allow thinner or shorter or lighter flange sections (3), and/or lighter floor sections (2). The strengthening plate is typically, but not exclusively, situated on the flange section (3) only (see FIGS. 1*a* and 1*b*—the CUD and C-plate), but in some embodiments it may be a single plate situated on both the flange section (3) and the floor section (2) and extending around the angle between the two sections, or may be two plates, one on each section. In other embodiments, the strengthening plate may be situated on the floor section (1) only, provided that sufficient strengthening of the flange section (3) is thereby achieved. Typically, the strengthening plate (4) is situated under the surface (7) of the monocoque (6), as shown in FIGS. 1*a* and 1*b*. The nature of the strengthening plate (4) is not especially limited, but typically it is formed from a plurality of layers laminated together, and/or from unidirectional fibres. In typical embodiments, it is formed from carbon, such as laminated carbon, and/or carbon fibres. In these embodiments the plate is termed a carbon plate, or C-plate.

In further embodiments, the floor section (2) is strengthened by providing it with a strengthening portion (5). In the present context 'strengthening' means any kind of strengthening as defined above, and especially stiffening. The strengthening is typically sufficient to allow thinner or shorter or lighter flange sections (3), and/or lighter floor sections (2). The strengthening portion (5) is typically, but not exclusively, situated at the end of the floor section (2) distal to the flange (see FIGS. 1*a* and 1*b*—the pultrusion). Typically, the strengthening portion (5) is situated under the surface of the monocoque (6), as shown in FIGS. 1*a* and 1*b*. The nature of the strengthening portion (4) is not especially limited, but typically it is formed from a plurality of layers laminated together, and/or from unidirectional fibres. In typical embodiments, it is formed from carbon, such as laminated carbon, and/or carbon fibres.

The floor elements (1) of the invention may comprise one or both of the strengthening element (4) and the strengthening portion (5). The floor elements (1) are typically manufactured by pre-forming the strengthening plate (4) and/or the strengthening portion (5), and then laminating the strengthening plate (4) and/or the strengthening portion (5) to the floor element in a mould to form the monocoque floor element (1).

In the present context, the term monocoque is intended to mean a form or structure that supports structural load by using an object's exterior, and/or a form or structure in which the chassis is integral with the body. This is as opposed to using an internal frame, truss, or the like that is then covered with a non-load-bearing outer section, skin or the like. In the present context the term monocoque is considered to be synonymous with structural skin, stressed skin, unit body, unibody, unitary construction, or Body Frame Integral (BFI) construction.

The present invention will now be described in further detail by way of example only, with reference to the accompanying drawings in which:

FIGS. 1*a* and 1*b* show examples of a floor element (1) showing a floor plate (2), a flange (3), a strengthening plate (4) (CUD or C-plate), a strengthening portion (5) (unidirectional pultrusion) and the monocoque structure of the element (6).

Figure 2A:
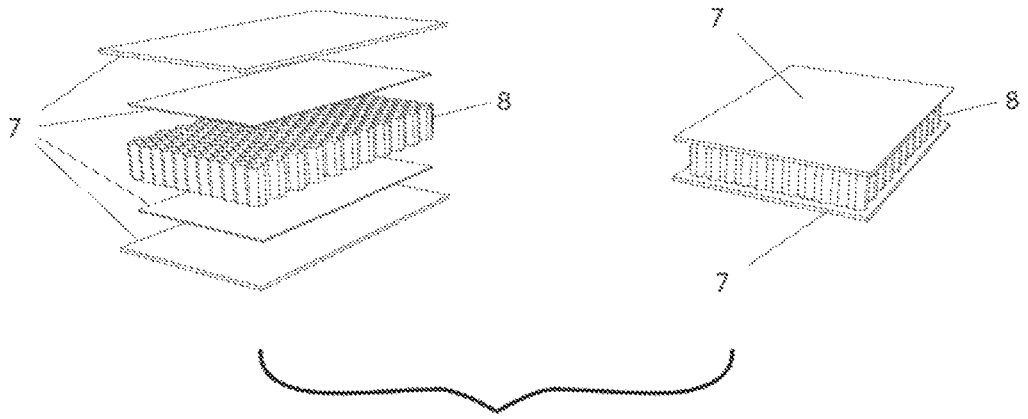

FIG. 2*a* shows a sandwich construction, which may be used for the monocoque structure (6) in the present invention. A structural panel is shown, consisting of two relatively thin, dense, high strength and parallel sheets of structural material (7) with their faces bonded to and separated by a relatively thick, lightweight core (8) such as honeycomb or foamed plastic.

Figure 2B:
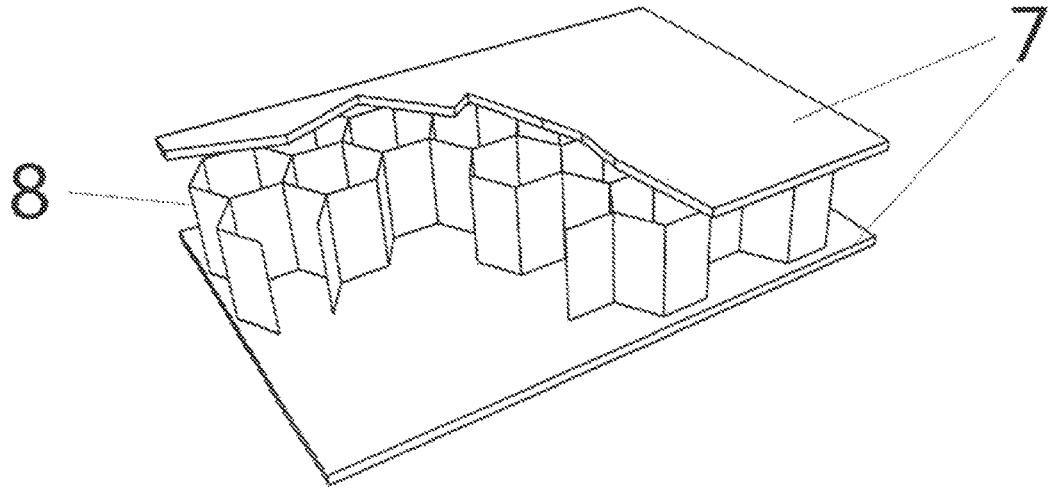

FIG. 2*b* shows a closer view of the typical honeycomb structure. Two load-bearing skins (7) are separated by a core of stiffening material (8), generally lightweight, to provide high strength, and rigidity. The two load-bearing materials typically have different physical properties.

Figure 3A:
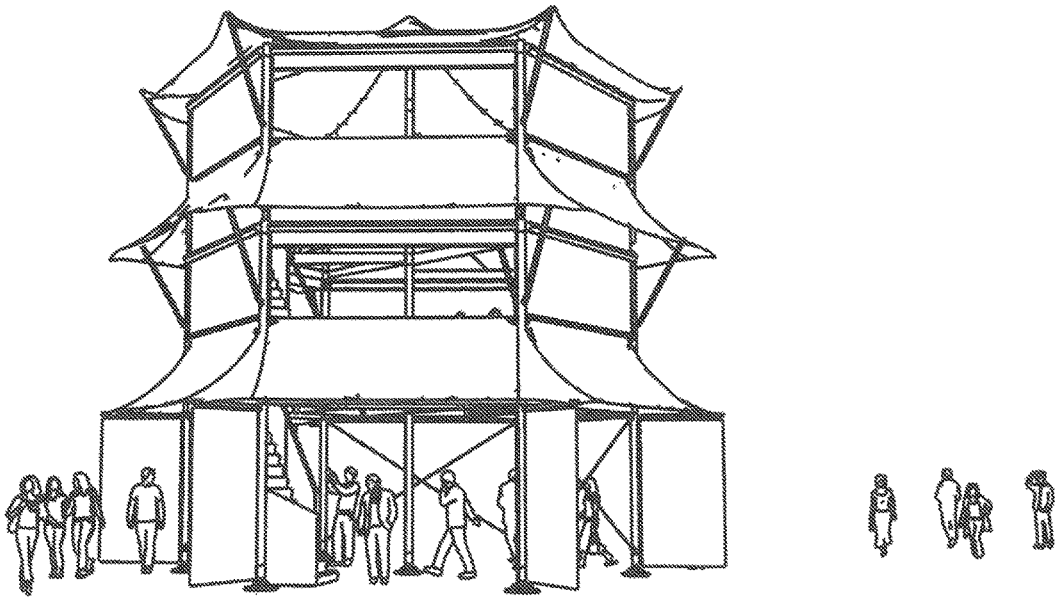
Figure 3B:
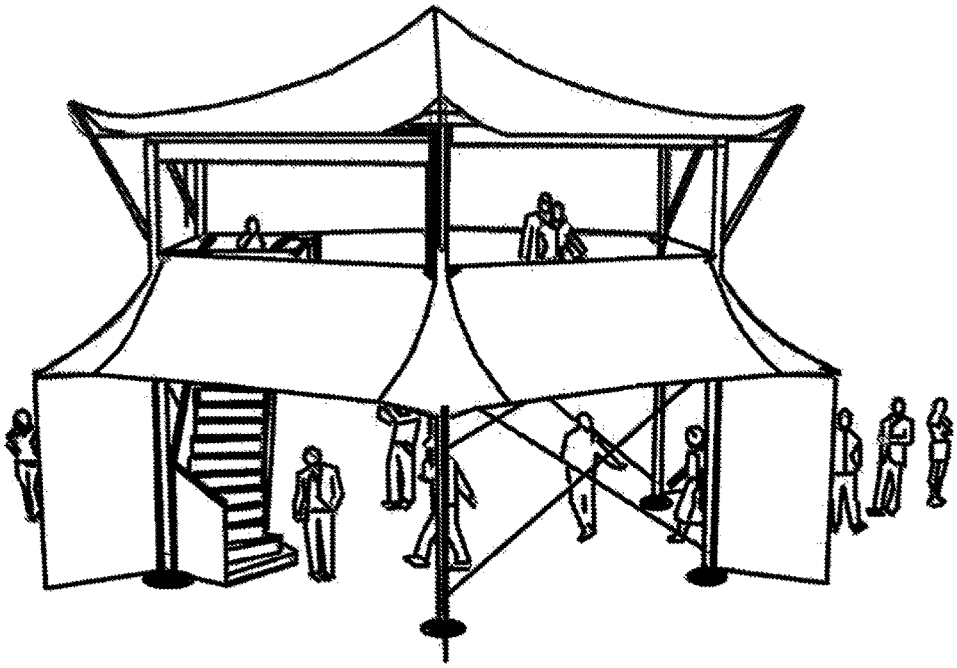
Figure 3C:
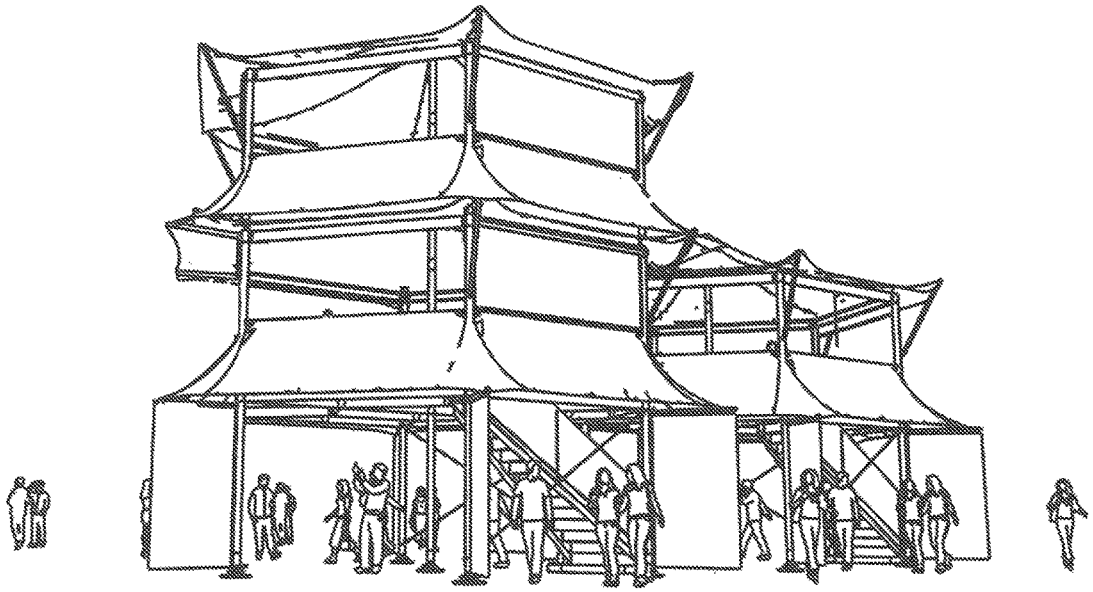

FIGS. 3*a* to 3*c* show exemplary hexagonal viewing platforms formed from kits of the present invention—in these exemplary structures, the platform is raised from the ground using supporting legs, and the floor elements are formed as equilateral triangles to facilitate formation of a hexagonal structure with all-round viewing capacity.

Figure 4A:
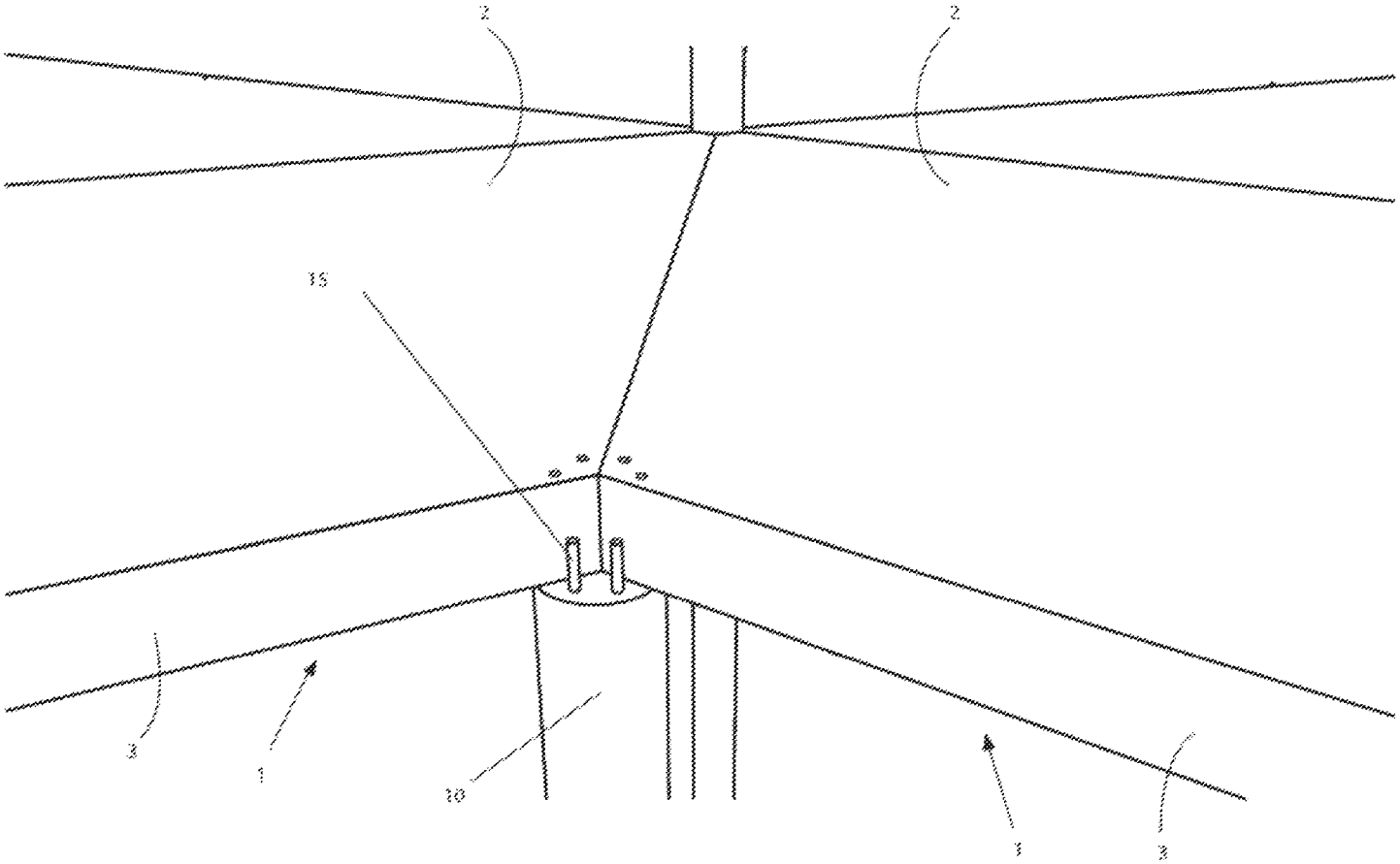
Figure 4B:
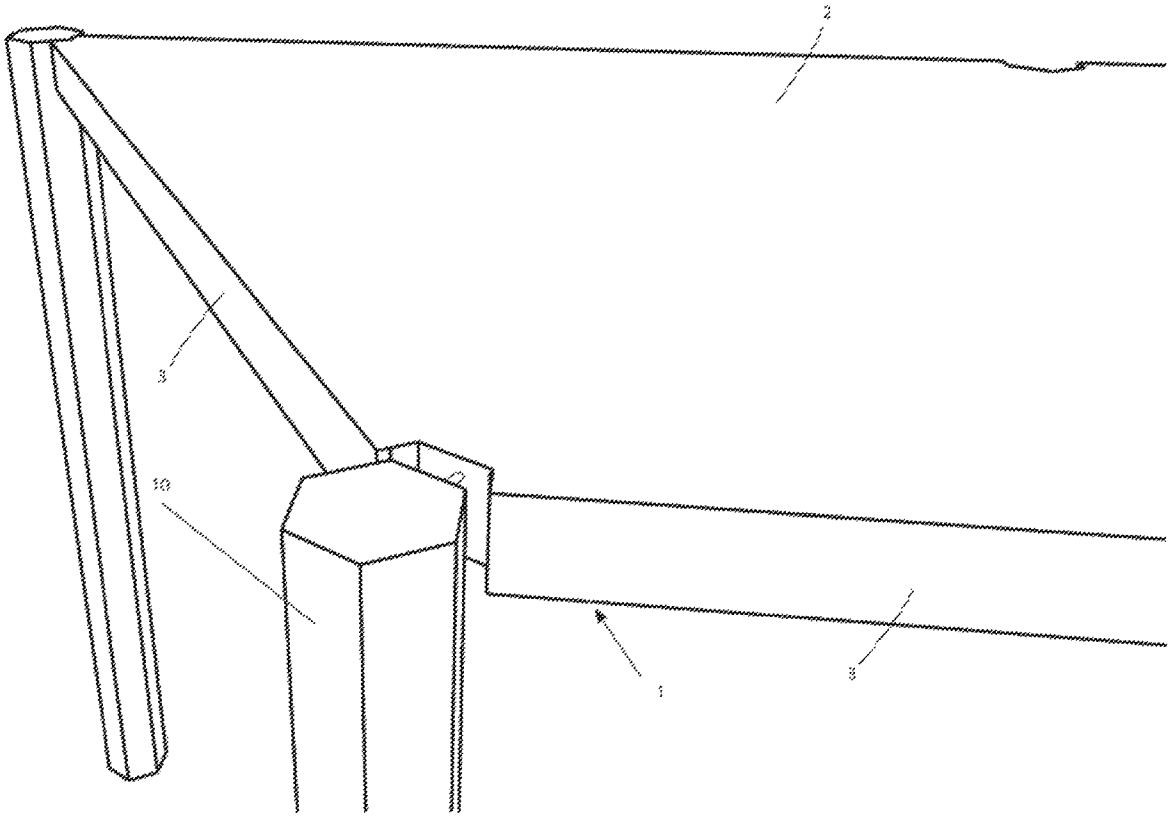
Figure 4C:
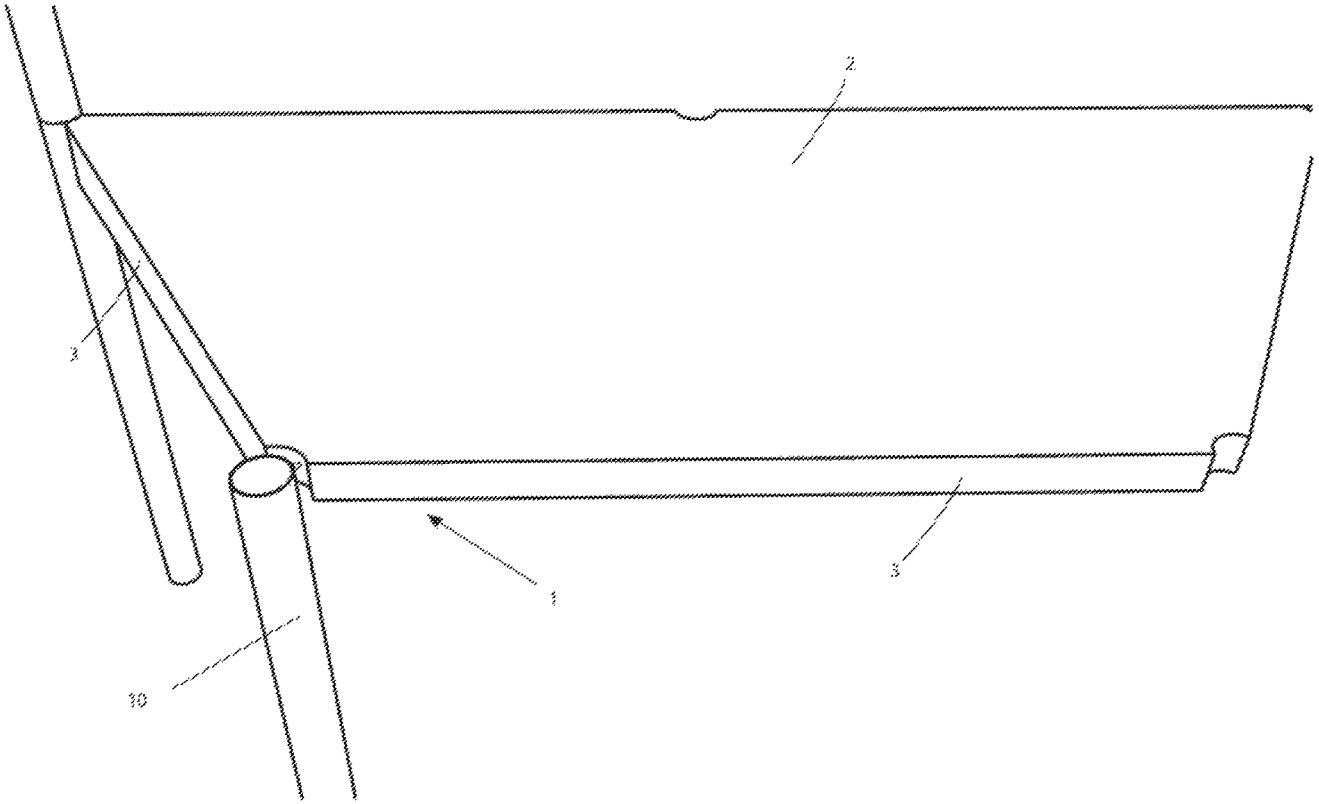
Figure 5A:
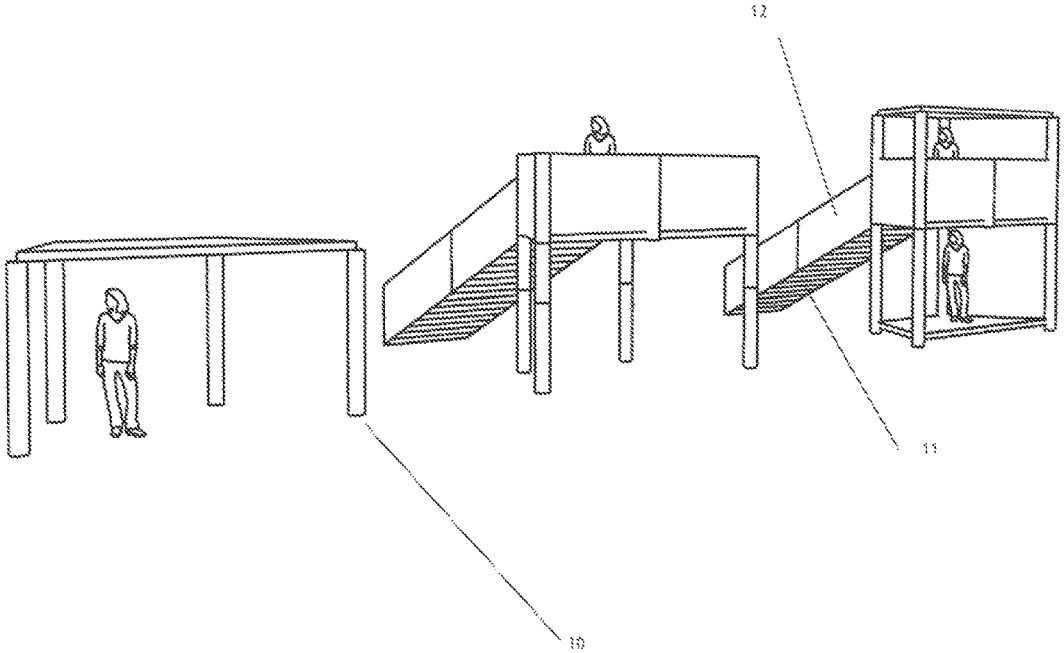
Figure 5B:
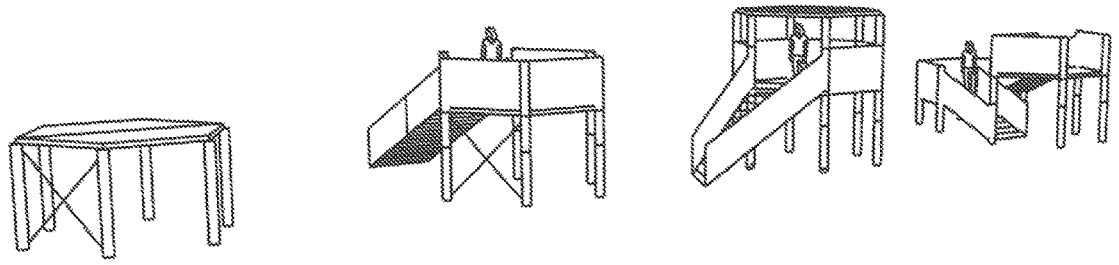
Figure 5C:
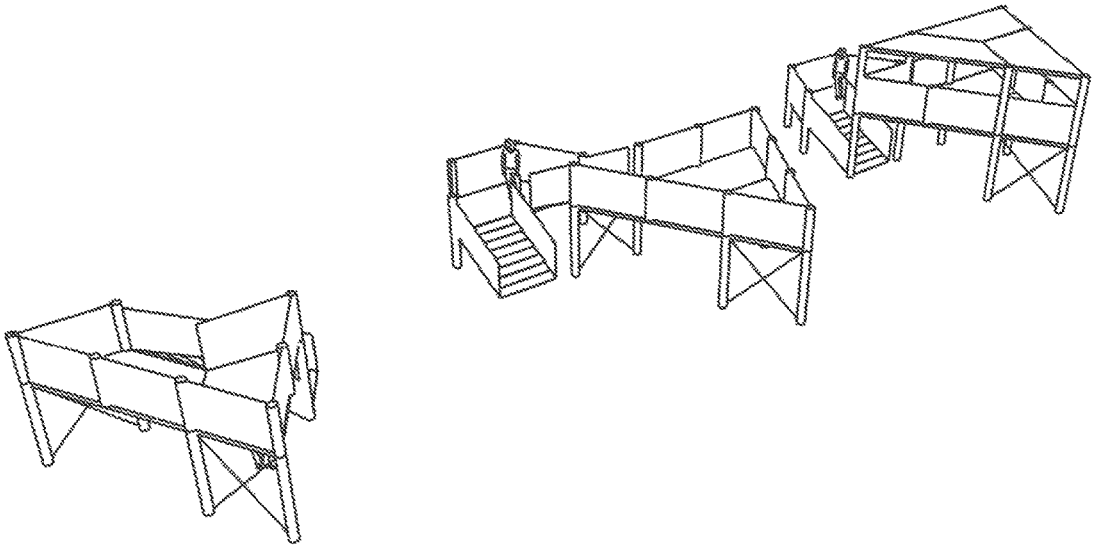
Figure 5D:
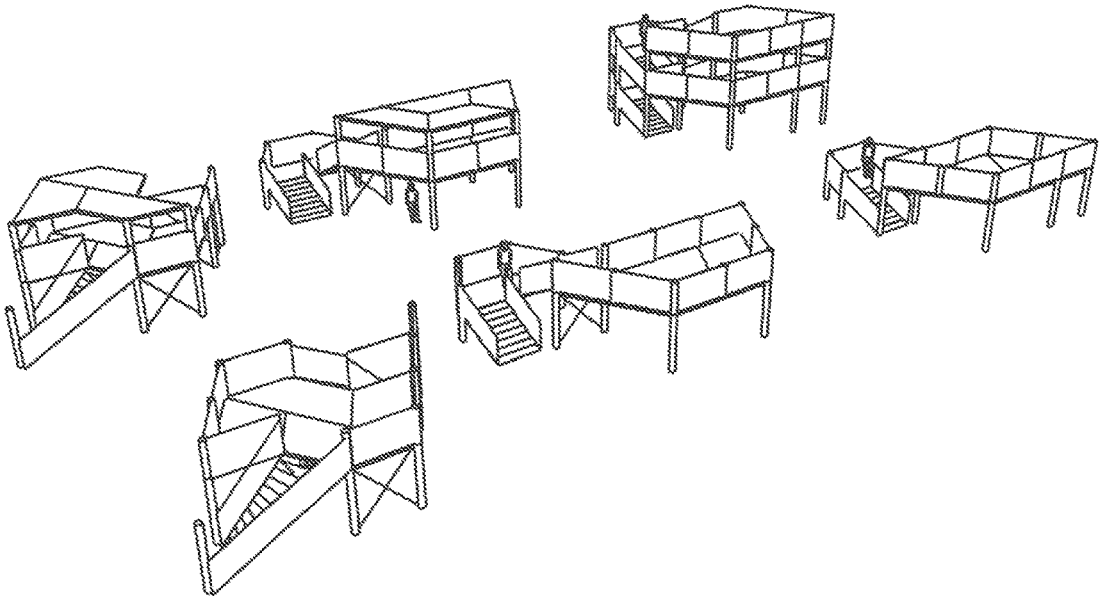
Figure 5E:
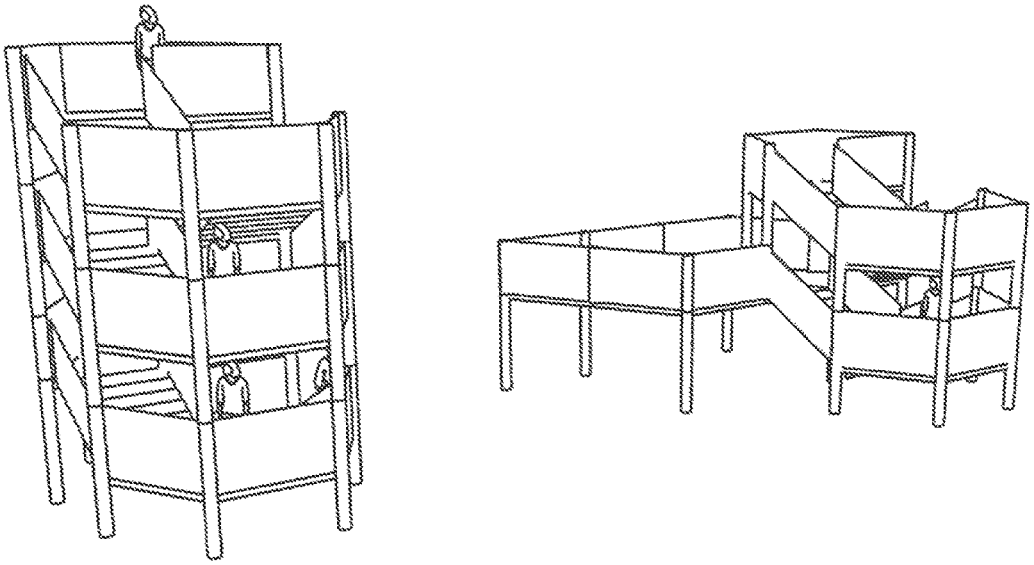

FIG. 4*a* shows an example of a connection for fixing a leg element (10) to one floor element (1) or two adjacent floor elements (1). FIGS. 4*b* and 4*c* show how adjacent floor elements (1) may be adapted to define an appropriately shaped hole into which leg elements (10) may be fixed.

FIGS. 5*a* to 5*e* show exemplary kits formed from 1, 2, 3, 4 and 5 floor elements (1) (panels) respectively.

Figure 6A:
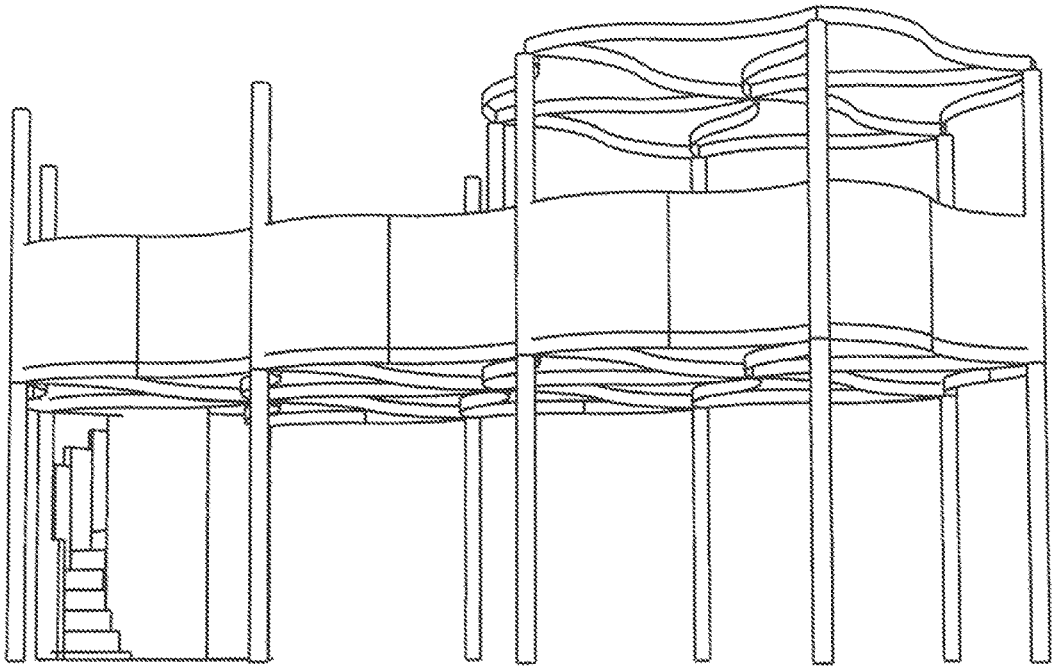
Figure 6B:
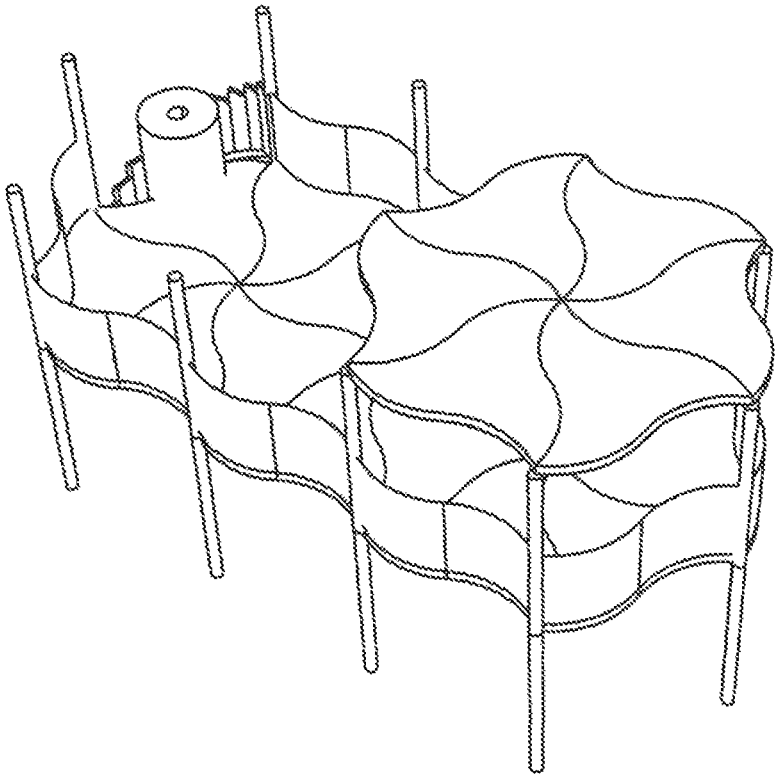

FIGS. 6*a* and 6*b* show exemplary kits formed from non-linear tessellating floor elements (1), in this case curved elements.

Figure 7A:
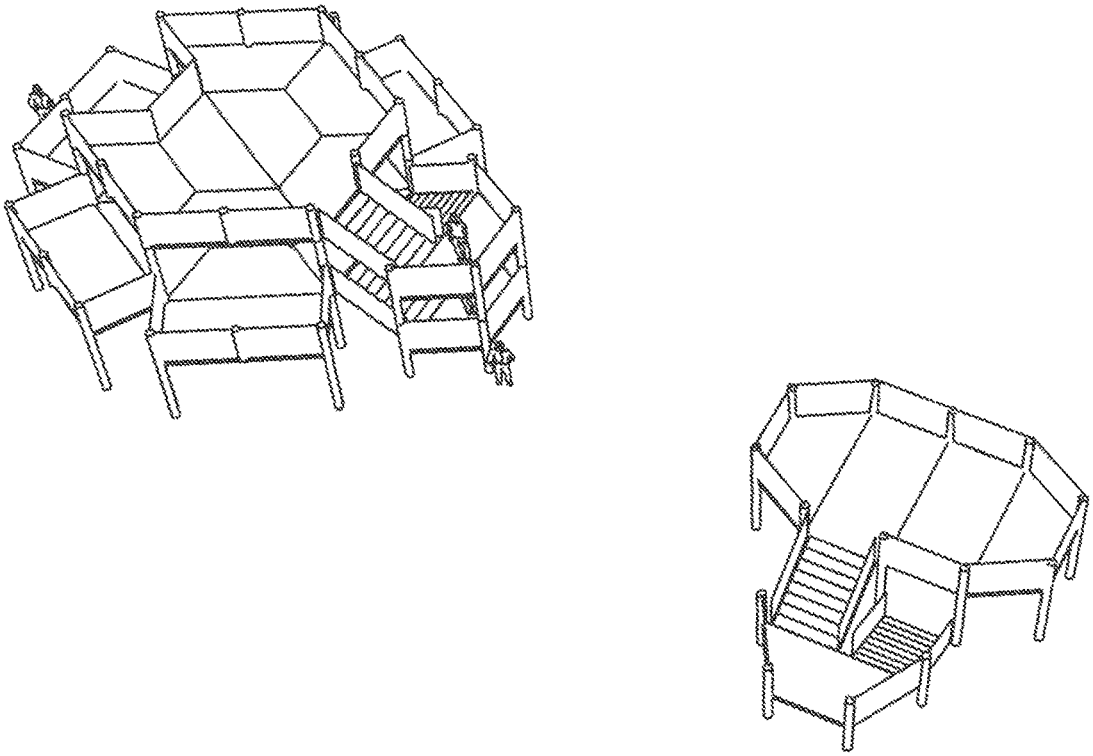
Figure 7B:
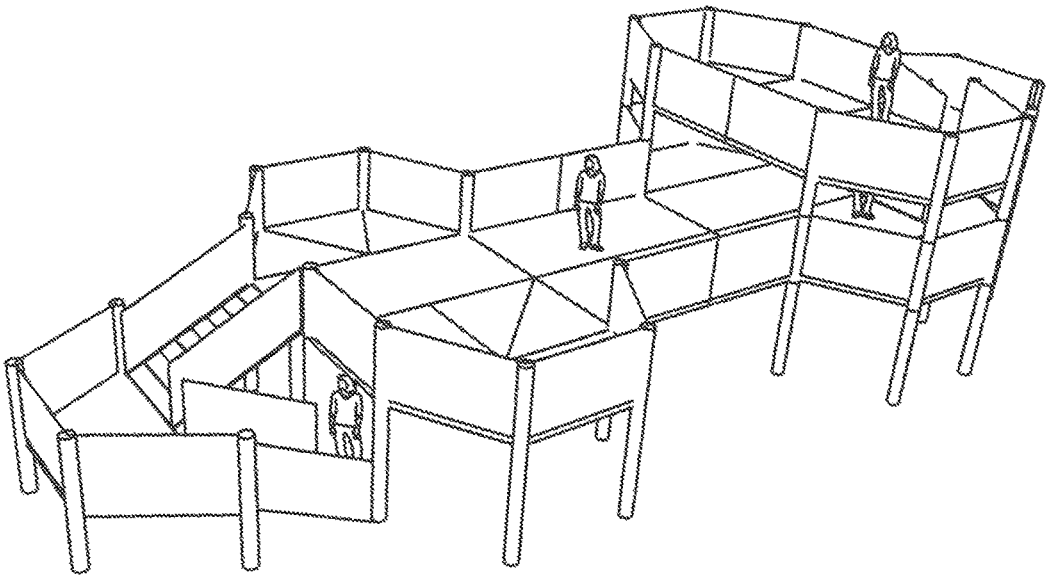

FIGS. 7*a* and 7*b* show exemplary kits formed from two or three different shaped floor elements (1), in this case rectangular and trapezoidal, and triangular rectangular and trapezoidal, panels respectively.

The floor elements (1) are not especially limited, provided that they are of a monocoque construction (6) and comprise the appropriate floor plate (2) and flange (3) in a single element, i.e. an integrated element that is formed in a single piece. Thus the floor elements (1) can be any shape or size, and this may be selected depending upon the type of platform required, the number of viewers and/or the weight bearing load required, and/or the direction or directions of viewing required. Typically the floor elements (1) have a side length of from 100 mm to 15,000 mm. The depth of the floor elements (1) is also not especially limited, and may be selected depending upon the type of viewing platform required, and typically upon the weight bearing load required. Typically the floor elements (1) have a depth of from 10 mm to 1,000 mm. The weight of the floor elements (1) is not especially limited, and may be selected depending upon the type of platform required, and its method of construction. Typically, the weight of the floor elements is from 10 kg to 500 kg.

The shape and configuration of the flange part is not especially limited, provided that it is capable of strengthening a floor element as compared with a floor element with no flange part, and provided that it is capable of being attached, joined or fixed (either directly or indirectly—i.e. directly by attachment with bolts, screws or other like fixing means, or indirectly using a fixing element as described below) to a further element of the kit. Typically it is adapted to be attached to the flange part of another floor element to join together two or more floor elements such that the floor parts form a suitable floor. However, it may also be adapted to be fixed to other elements, such as handrail elements or stair elements, or to two, or more, or all elements in the kit. Typically the flange part forms an angle with the floor part, and more typically the angle is between 80-100°, most typically approximately 90°. The flange section is typically adapted so that it protrudes below the floor section, such that it does not interfere with the even nature of the floor. However, in some embodiments, the flange part may protrude above the floor part and form a fixing point for further floor pieces. Such further floor pieces are optional and would not need to be load bearing, but may be of interest for aesthetic, or other reasons in some instances. An example of a floor element showing a floor plate, a flange section, and having a monocoque structure is shown in FIG. 1. In this diagram an optional box section is shown, which may enable the further floor pieces to rest thereupon if the flange part were protruding above the floor.

The structure and materials forming the floor elements (1) used in the present invention are not especially limited, provided that they do not prevent the elements from constructing a suitable platform in accordance with the invention. Typically, the floor elements (1) comprise a core material (8) surrounded by a structural skin or shell (7), thus creating a monocoque structure (6) (see FIG. 2*a* and FIG. 2*b*). In this arrangement, the core material (8) is typically low density, being designed to carry shear loading, whilst the surrounding structural skin (7) is designed to carry the compressive and tensile loads.

The materials from which the skin (7) is formed are not especially limited, provided that they do not prevent the elements from constructing an appropriate platform in accordance with the invention. Thus a sandwich-type structure may be employed, as shown in FIGS. 2*a* and 2*b*. The skin (7) may typically comprise a strong, yet lightweight material, such as a lightweight metal (e.g. aluminium or titanium), but more typically, composite materials are employed. In the present context, composite materials means materials that are formed from two or more constituent materials with significantly different physical or chemical properties. Typically these physical or chemical properties remain separate and distinct on a macroscopic level within the finished structure. Desirable composite materials include, but are not limited to, light and strong materials, such as lightweight metal (e.g. aluminium or titanium), carbon-based materials (such as carbon fibre, nanotube fibre and graphene), glass fibre (e.g. e glass or s glass), spectra fibres, PVA fibre, structural foam, wood (e.g. balsawood, plywood, bamboo and the like), man-made fibres (e.g. aramid (Kevlar or Twaron) and the like), boron fibre, cellulose fibre, combinations of two or more of the above, and woven, stitched, braided or 3*d* fabrics formed from one or more of the above. A combination of woven carbon and glass fibre is particularly preferable.

The core material (8) is not especially limited, provided that the function of the element is not unduly impaired, and may comprise metal (e.g. aluminium), a foam, an aerogel, a woven 3d structure, wood (e.g. balsa), glass fibre, pultrusions (unidirectional materials, such as carbon or glass used to add stiffness e.g. to the ends of flanges or floor sections), laminates (e.g. carbon laminates formed from multiple layers of carbon materials) and other light materials. End-grain balsa wood is particularly advantageous. It has exceptional bond, high impact and fatigue resistance with excellent strength/stiffness and lightweight properties. It also has a high aspect ratio and directionally aligned cells such that the grain is oriented in the direction of the maximum stress. The structure of the core (8) is not especially limited, and may be arranged either as a block or as a structurally efficient supporting member such as a honeycomb. An exemplary structure is shown in FIG. 2*b*. The core (8) is typically held within a resin matrix to help bind the core materials together. The resin may further add to the strength of the composite material. Typical resins include those formed from polyester, epoxy, vinyl ester, phenols, and polyurethane.

The floor elements (1) of the platform are typically fixed together via their flange sections (3). Typically adjacent flange sections (3) are attached to each other. However, not all adjacent flange sections (3) need to be attached. The skilled structural engineer will appreciate the necessary attachment points based upon the nature of the platform, and the load that the specific platform is designed to bear.

The attachment of the flange parts (3) is not especially limited, provided that it does not adversely affect the structural integrity of the platform. The flange parts (3) may, for example, be bonded (e.g. with an adhesive substance) or mechanically fastened together (e.g. using bolts, screws, rivets, or the like). Typically the flange parts (3) are held together using a fixing element (15), which fits reversibly into a hole between two flange parts as defined when two floor elements (1) are placed adjacent to each other. The hole may be defined by missing sections of the flange parts (3), or by curving of the flange parts (3), or by thinning of the flange parts (3), or the like. Alternatively, the fixing element (15) may be a connection. The connection may be any fastening means (15) adapted to fasten the two flange parts (3) together. The fixing element (15) is, however, not limited, and may be any article, part or insert that is adapted to fit in a hole formed from the two adjacent floor elements (1), or to fix the two adjacent floor elements (1) together. Typically the fixing element (15) comprises a peg or dowel which may slot into the hole, holding the two floor elements (1) together. The fixing element (15) may hold the two elements (1) together alone, without the need to be held in place in the hole, or may be held in place using an attachment means, such as adhesive, bolts, screws, rivets or the like. Alternatively, the fixing element (15) may employ a snap-fit type connection, or a complementary male and female type connection. The fixing element (15) may be a leg (10) (see FIGS. 4*a*, 4*b* and 4*c*), which serves to distance the floor from the ground. In this arrangement, not all attachment holes need to be fixed using a leg, and some may be fixed using a dummy leg (a leg which does not need to bear (or does not bear) any load) or with the dowel, peg or other fixing element.

The aforementioned modular construction kit is not only capable of, but is indeed specifically adapted to, produce a particular range of types and shapes of temporary platform, and especially types of free-standing temporary viewing platform. Typical examples include, but are not limited to rectangular, circular, elongate, hexagonal and square shaped horizontal free-standing viewing platforms and combinations of these.

It is further preferred that the temporary platform of the invention has at least one floor raised sufficiently above ground level for people to walk under (see FIGS. 5-7). It is further preferred that the temporary platform of the present invention is a multi-storey platform (having 2 or more storeys connected by stair elements—see FIGS. 5-7). The temporary structures of the present invention are particularly light and strong and making them especially useful for constructing such multi-storey temporary platforms.

By providing a modular construction kit which is adapted to form a specific range of types and shapes of temporary platform, the modular kit is more readily constructed than, for example, systems which are not adapted for any particular type or shape of structure. The structures provided by the modular construction kit allow a degree of flexibility that is absent from systems which are specifically adapted for one particular type or shape of structure. Typically, but not exclusively, in order to provide this specific adaptability the invention provides floor plates (2) which have a rectangular shape, a square shape, an equilateral triangular shape, a right-angled triangular shape, and/or an isosceles trapezoidal shape. Such floor plates (2) are ideally adapted for constructing rectangular, square, hexagonal and/or linear shaped platforms, or other shapes (such as irregular and/or modular shapes), and shapes which include combinations of two or more of the above shapes (see FIGS. 7*a* and 7*b*).

According to one embodiment, the invention provides a kit comprising at least one floor element (1), at least two leg elements (10) and at least one stair element (11). Such a kit typically, but not exclusively, also comprises one or more handrail elements (12). In a further embodiment, the invention provides a kit comprising at least two floor elements (1), at least one fixing element (15), at least two leg elements (10) and at least one stair element (11). Such a kit also typically, but not exclusively, comprises one or more handrail elements (12).

A further kit of the invention comprises at least six floor elements (1) having an equilateral triangular shape. This kit is particularly well suited to the construction of a hexagonal shaped viewing platform. In some embodiments, the kit may comprise a larger number of smaller triangular floor plates (1). This can be advantageous because it allows for narrow elongate viewing platforms to be readily constructed using the same elements. Furthermore, in this arrangement, the floor elements (1) may be smaller, and are thus easier to handle during construction and more readily transportable. Thus, the invention also provides a kit comprising at least twenty four floor plates (1) having an equilateral triangular shape. This kit is particularly well suited for the construction of a hexagonal shaped viewing platform in which six floor elements (1) form a central hexagonal structure with the remaining eighteen disposed around the central hexagonal structure in an alternating orientation to form a larger hexagonal structure for the hexagonal viewing platform.

One problem with this arrangement is that a relatively large number of floor plates (1) are required and all these floor plates must be arranged and supported to form the viewing platform which can be relatively time consuming.

Accordingly, in one particular advantageous embodiment the eighteen triangular floor plates (1) disposed around the central hexagonal structure can be replaced with five isosceles trapezoids and a stair element (11), or six isosceles trapezoids. Each isosceles trapezoid has a base twice as long as its top with sides of equal length, the sides also being equal in length to the top of the trapezoid. As such, each isosceles trapezoid has an area three times the area of each central equilateral triangular floor plate (1). Thus the number of floor plates (1) required for a hexagonal viewing platform is reduced from twenty four to eleven or twelve. According to this embodiment the modular construction kit comprises at least six equilateral triangular floor plates (1) and at least five or six isosceles trapezoid floor plates (1). This has been found to be a good compromise between the required size for the floor plates (1) and the required number of floor plates (1) to construct viewing platforms having a suitable size. The trapezoid floor plates (1) have also been found to be useful in forming long thin platforms such as walkways without requiring as many joints as with their triangular shaped counterparts.

Yet another option to further reduce the number of floor plates (1) is to replace the six central triangular floor plates (1) with a single hexagonal central floor plate (1). According to this embodiment the modular construction kit may comprise at least one hexagonal floor plate (1) and at least five or six isosceles trapezoid floor plates (1). The hexagonal floor plate (1) should have a side length equal to the top of each isosceles trapezoid. Alternatively, the central hexagonal floor plate (1) may be surrounded by eighteen triangular floor plates (1) in order to construct a hexagonal viewing platform.

Yet another option is to use two isosceles trapezoid floor plates (1) to form the central hexagonal structure with five or six further isosceles trapezoid floor plates (1) disposed around the central hexagonal structure. According to this embodiment the modular construction kit may comprise at least seven or eight isosceles trapezoid floor plates (1). As referred to above, the place of the eighth isosceles trapezoid floor plate (1) which would finish the regular hexagon shape may be taken by a stair element (11) in raised platforms, or by a final eighth isosceles trapezoid floor plate (1) when no stair is required.

Various other configurations of floor elements (1) will be apparent to the skilled person, depending upon the nature of the viewing platform required. Thus, floor elements (1) comprising a floor section (2) having any other shape may be employed, and kits having floor plates (1) of a plurality of different shapes are envisaged (see FIGS. 7*a* and 7*b*). Thus, kits comprising floor elements (1) which have a floor plate (2) which is triangular, rectangular, square, rhomboid, parallelogramoid, pentagonal, hexagonal, heptagonal, octagonal, nonagonal, decagonal, and circular are also encompassed by the invention. Floor elements (1) may be any of the above shapes in complete form, or in semi or partial form (such as a semi-circle or the like). Floor elements (1) may also be formed from non-linear tessellating shapes (see FIGS. 6*a* and 6*b*). Typically, but not exclusively the floor plates (1) in a kit are all the same shape, but kits with two or more shapes, three or more shapes, four or more shapes etc. are also envisaged.

The kits of the present invention may comprise further elements, depending upon the nature of the platform to be constructed. The further elements are typically, but not exclusively, formed from the same materials as the floor elements (1). In some embodiments, the further elements are provided with a flange (3) to facilitate construction. Exemplary further elements are discussed below.

Further elements may include one or more handrail elements (12), which may be adapted to be mounted to the floor elements around a circumference of the floor for preventing a user from falling over an edge of the temporary platform. Such handrail elements (12) are typically, but not exclusively, attached to the flange section (3) of the floor elements (1). The method of attachment is not especially limited, and any attachment means (15) mentioned above may be employed, such as adhesive, bolts, screws, rivets or the like.

In some embodiments, particularly those where the platform is designed to have multiple storeys, the kits may further comprise one or more stair elements (11). The stair elements (11) may be adapted to be mounted to one or more of the floor elements (1), whereby a user can climb the stair element to access a higher storey. Such stair elements (11) are typically, but not exclusively, attached to the flange section (3) of the floor elements (1). The method of attachment is not especially limited, and any attachment means (15) mentioned above may be employed, such as adhesive, bolts, screws, rivets or the like. The stair element (11) may itself also comprise, or be adapted to be attached to, one or more handrail elements (12), if desired.

As mentioned, the kits may also be specifically adapted to provide a platform which is sufficiently raised such that members of the public can readily stand or walk under it. Such a platform does not provide an obstacle to the flow of people at ground level which would otherwise be problematic for events at which large crowds are present. Alternatively, the space underneath the temporary platform may be used, for example, as a bar or the like. In such embodiments, to ensure that members of the public can readily walk under the platform, the kit may comprise legs (10) which are at least 6 feet (1.829 meters) long which can be orientated in a vertical direction for supporting the platform. More preferably, the legs (10) are at least 7, 8 or 9 feet (2.134, 2.438 or 2.743 meters) long. In some instances shorter legs may be employed, provided that these legs are extendable to at least 6, 7, 8 or 9 feet (1.829, 2.134, 2.438 or 2.743 meters) in length. For example, the legs (10) may be telescopic. Such telescopic support legs may be adapted to be extendable and fixed at a number of different lengths according to a desired use.

The legs (10) and the floor elements (1) must be strong enough such that the platform can be supported with a relatively small number of legs (10). A dense configuration of legs is preferably avoided as this would render the space underneath the platform less useful, and provide an obstacle to the flow of people at ground level. For example, according to one preferred arrangement a hexagonal viewing platform is provided with seven support legs (10), one at each point of the hexagon and one in the centre of the hexagon. Preferably the legs (10) are at least 6 feet (1.829 meters) apart to allow people to walk under the temporary platform without being unduly impeded.

The temporary platforms of the present invention are more aesthetically pleasing than previous arrangements using, for example, conventional scaffolding or the like. The pleasing aesthetic quality of the present invention is achieved by providing the combination of features described previously. The triangular, trapezoid, hexagonal, linear, and other shaped structural components of the platforms in combination with a relatively disperse supporting structure has been found to be particularly aesthetically pleasing.

Embodiments of the present invention can be used to create a wide variety of different temporary platform structures comprising hexagonal decks, rectangular decks, elongate linear stages, and other configurations. This is advantageous when compared with known systems which are not adapted to produce any specific type/shape of structure or are adapted to form a single structure or variants of the single structure such as a shorter or longer stage of the same shape. The components of the present modular construction kit are adapted to be readily attached and taken apart in order to allow easy construction and transportation which is required for such temporary structures as opposed to more permanent building structures.

For example, the components may be adapted so as to be attachable using nuts and bolts, snap-fit type connections, or complementary male and female type connections rather than using, for example, nails, screws, welds, adhesive or cement as in more permanent constructions.

Further elements that provide extra functionality to the kits may be included. Exemplary further elements include one or more of the following:

- Canting feet which may fit onto the base of the legs—allows for leveling of legs locally;
- Padeyes (adapters between legs, handrails, stays, etc.);
- Tenting (e.g. top, side walls, awnings)—tensile, stretch fabric or composite mouldings for weather-proofing and aesthetics (see FIG. 3);
- Blinds and blind channels, to temporarily close out the weather on the sides of the structure
- Lift for disabled access
- Heaters for warmth; and
- Lighting.

Still further elements that aid in construction and dismantling the platforms may also be included in the kits of the invention. Examples of these include:

- Panel lifts formed from steel cables with winches for lifting floor elements and other elements into place;
- Ladders to get construction workers into place to fix the parts together;
- Nuts/bolts/screws/adhesives and/or other fixing means;

Staying cable (steel or composite cable) to create cross bracing to reduce movement of the structure; and elbow braces and/or cross braces to reduce movement but allow people to walk through the structure.

Particularly advantageous aspects of the further elements of the kits of the invention will now be described by way of example only.

EXAMPLES

Some specific examples of elements of the kit, including their exemplary sizes, weights and functions are provided below.

Floor Elements (1)

Structure: Monocoque sandwich floor elements.

Size/weight: Small—1,000 mm×2,000 mm (weight approx. 40 kg)—2 man lift/Large—2,000 mm×12,000 mm (weight approx. 240 kg)—forklift crane/10 man lift.

Thickness: Depth 200 mm.

Function: For supporting people and furniture in multi story levels.

Fixing Elements (15)

Structure: Aluminum or composite.

Size/weight: Depends on depth of floor elements—typically 200 mm—weight approx. 4 kg.

Function: Allows for quick fit between floor elements—e.g. click in and move on.

Leg Elements (10) (May Also Act as Fixing Elements)

Structure: Composites filament wound, pultruded, pul-wound, or wrapped carbon over a spindle. May also comprise aluminium extrusion. May be round, square, hexagonal, octagonal, or 12-sided in cross section.

Size/weight: Height 8 feet 2,470 mm (typical height of stairs)—weight approx. 10 kg.

Function: Provide elevation from the ground and between floors—can additionally be used as fixing element.

Jack Element (Adjustable Height)

Structure: Aluminium or steel.

Size/weight: 1.2-1.6 m.

Function: To adjust height of structure on uneven ground or to raise the structure above the ground to better the view.

Feet Elements (Adjustable Feet)

Structure: Aluminum.

Size/weight: Length 1.6 m—weight approx. 10 kg, and/or preferably minimum 300 mm diameter.

Function: Allows for unlevelled terrain—approx 7 degrees per 8 m or 1 m of height every 8 meters.

Handrail Elements (11)

Structure: Composites, glass, metal, or wood

Function: Handrails enhance safety to prevent people falling—may optionally help stabilize the structure by bracing floor elements, stair elements, and/or other elements to which they are attached.

Stair Elements

Structure: Composites

Function: Access to different levels

Size: Height 2,470 mm

The invention claimed is:

1. A modular construction kit adapted to construct a raised temporary platform, the modular construction kit comprising two or more floor elements (1), wherein each floor element (1) comprises a monocoque structure (6) forming a floor section (2) and a flange section (3), wherein the floor section (2) and the flange section (3) each comprise a core material surrounded by a structural skin, wherein the flange section (3) is adapted to strengthen the floor element (1) and is adapted to be removably attached to a further floor element (1), wherein the structural skin of each of the floor section (2) and the flange section (3) is load bearing and cooperates with the further floor element to bear the load of the platform so as to form a self-supporting floor, without the requirement for a supporting floor frame, which kit further comprises a least one fixing element (15) for removably fixing together the two or more floor elements (1), wherein the core material comprises a metal, a wood, a glass fibre, carbon, aerogel, a woven 3d structure, a pultrusion or a laminate.

2. A kit according to claim 1, wherein two adjacent floor elements (1) define a hole into which the fixing element (15) is adapted to removably fit to fix together the two adjacent floor elements.

3. A kit according to claim 1, comprising one or more fixing elements (15) comprised of one or more of a peg, a dowel, and a leg.

4. A kit according to claim 1, which kit further comprises one or more additional elements, which additional elements are selected from: a handrail element (12); a leg element (10); a jack element; and a stair element (11).

5. A kit according to claim 4, wherein the handrail element (12) and/or the stair element (11) is adapted to provide structural strength to the platform.

6. A kit according to claim 4, wherein the leg element (10) is at least 6, 7, 8 or 9 feet (1.829, 2.134, 2.438 or 2.743 meters) long.

7. A kit according to claim 4, wherein the jack element is adjustable such that the height of the platform can be controlled.

8. A kit according to claim 1, comprising at least two floor elements (1), at least two leg elements (10) and at least one stair element (11).

9. A kit according to claim 8, further comprising one or more handrail elements (12).

10. A kit according to claim 1, comprising at least two floor elements (1), at least one fixing element (15), at least two leg elements (10) and at least one stair element (11).

11. A kit according to claim 1, which kit comprises one or more further elements selected from: a canting foot, a padeye, tenting, a heater and lighting.

12. A kit according to claim 1, which kit comprises one or more further elements selected from: a panel lift, a ladder, a fixing means (15), staying cable, a cross brace; an elbow brace, an elbow joint and a shoulder.

13. A kit according to claim 1, wherein each of the floor elements (1) in the kit comprise a floor section (2) of the same shape, or wherein the floor elements (1) in the kit comprise floor sections (2) of at least two different shapes, at least three different shapes or at least four different shapes.

14. A kit according to claim 13, wherein the floor section (2) is selected from one or more of the following shapes: triangular, rectangular, square, rhomboid, parallelogramoid, pentagonal, hexagonal, heptagonal, octagonal, nonagonal, decagonal, circular, and non-linear tessellating shapes, and semi- or partial shapes of the above.

15. A kit according to claim 14, wherein the floor elements (1) comprise at least one floor section (2) capable of forming a central hexagonal floor, and at least seven further floor sections (2) having an isosceles trapezoid shape for extending the central hexagonal floor outwards.

16. A kit according to claim 14, wherein each floor section (2) comprises a single floor section (2) having a hexagonal shape, or two floor sections (2) having an isosceles trapezoid shape.

17. A kit according to claim 15 or claim 16, further comprising an eighth further floor section (2) having an isosceles trapezoid shape for extending the central hexagonal floor outwards, or further comprising a stair element (11) and two or more leg elements (10) for raising the platform off the ground.

18. A modular construction kit according to claim 1, wherein the floor elements (1) are formed from a material comprised of a composite.

19. A modular construction kit according to claim 1 wherein the core material is arranged as a block or a honeycomb.

20. A method of constructing a temporary platform comprising providing a modular construction kit, wherein the modular construction kit comprises two or more floor elements (1), wherein each floor element (1) comprises a monocoque structure (6) forming a floor section (2) and a flange section (3), wherein the floor section (2) and the flange section (3) each comprise a core material surrounded by a structural skin, wherein the flange section (3) is adapted to strengthen the floor element (1) and is adapted to be removably attached to a further floor element (1), wherein the structural skin of each of the floor section (2) and the flange section (3) is load bearing and cooperates with the further floor element to bear the load of the platform so as to form a self-supporting floor, without the requirement for a supporting floor frame, which kit further comprises a least one fixing element (15) for removably fixing together the two or more floor elements (1)

which method comprises disposing the floor elements adjacent to each other and attaching adjacent flange sections to form the self-supporting floor.

21. A method to claim 20 wherein the core material comprises a metal, a wood, a glass fibre, carbon, a woven 3d structure, a pultrusion or a laminate.

22. A temporary platform constructed using a modular construction kit, wherein the modular construction kit comprises two or more floor elements (1), wherein each floor element (1) comprises a monocoque structure (6) forming a floor section (2) and a flange section (3), wherein the floor section (2) and the flange section (3) each comprise a core material surrounded by a structural skin, wherein the flange section (3) is adapted to strengthen the floor element (1) and is adapted to be removably attached to a further floor element (1), wherein the structural skin of each of the floor section (2) and the flange section (3) is load bearing and cooperates with the further floor element to bear the load of the platform so as to form a self-supporting floor, without the requirement for a supporting floor frame, which kit further comprises a least one fixing element (15) for removably fixing together the two or more floor elements (1).

23. A kit of claim 1 or platform of claim 22, wherein the temporary platform is a free-standing temporary platform.

24. A kit or platform of claim 23, wherein the temporary platform is for viewing, observation, display, shows, and/or storage.

25. A temporary platform according to claim 22 wherein the core material comprises a metal, a wood, a glass fibre, carbon a woven 3d structure, a pultrusion or a laminate.

26. A floor element (1) for forming a floor, wherein the floor element comprises a monocoque structure (6), and comprises:

a floor section (2) and a flange section (3), wherein the flange section (3) is adapted to strengthen the floor element (1), and wherein the flange section (3) comprises a strengthening plate (4) moulded to a surface of the flange section (3), or a the floor section (2) and a flange section (3), wherein the flange section (3) is adapted to strengthen the floor element (1), and wherein the floor section (2) comprises a strengthening portion (5) moulded to a surface of the floor section (2), and wherein the flange section (3) is adapted to be removably attached to a further floor element (1), wherein the floor section (2) and the flange section (3) each comprise a core material surrounded by a structural skin, wherein the structural skin is load bearing, and wherein the core material comprises a metal, a wood, a glass fibre, carbon, aerogel, a woven 3d structure, a pultrusion or a laminate, wherein the strengthening plate (4) or the strengthening portion (5) is formed from a plurality of laminated layers from unidirectional fibres or both.

27. A kit for forming a structure comprising a floor element (1) as defined in claim 26.

28. A kit according to claim 27, wherein the kit comprises a plurality of floor elements (1) as defined in claim 26.

29. A method of forming a structure, comprising providing a kit as defined in claim 27, providing a further floor element, disposing the floor elements adjacent to each other, and attaching adjacent flange sections to form the structure.

30. A structure comprising a floor element (1) as defined in claim 26.

31. A structure according to claim 30, wherein the structure comprises a temporary platform.

32. A method of manufacturing a monocoque floor element (1) as defined in claim 26, which method comprises:

forming the strengthening plate (4) and laminating the strengthening plate (4) to the flange section (3) in a mould or forming the strengthening portion (5) and laminating the strengthening portion (5) to the floor section (2) in a mould to form the monocoque floor element (1).

33. A floor element according to claim 26, wherein the strengthening plate (4) or the strengthening portion (5) is formed from carbon.

* * * * *